US011383950B2

(12) United States Patent
Seifert

(10) Patent No.: US 11,383,950 B2
(45) Date of Patent: Jul. 12, 2022

(54) LONGITUDINAL CUTTING DEVICE

(71) Applicant: Kolbus GmbH & Co. KG, Rahden (DE)

(72) Inventor: Patrick Seifert, Niederau (DE)

(73) Assignee: Kolbus GmbH & Co. KG, Rahden (DE)

( * ) Notice: Subject to any disclaimer, the term of this patent is extended or adjusted under 35 U.S.C. 154(b) by 222 days.

(21) Appl. No.: 16/641,556

(22) PCT Filed: Aug. 20, 2018

(86) PCT No.: PCT/EP2018/025215
§ 371 (c)(1),
(2) Date: Feb. 24, 2020

(87) PCT Pub. No.: WO2019/037895
PCT Pub. Date: Feb. 28, 2019

(65) Prior Publication Data

US 2020/0172365 A1 Jun. 4, 2020

(30) Foreign Application Priority Data

Aug. 25, 2017 (DE) ..... 102017008068.2

(51) Int. Cl.
*B65H 35/02* (2006.01)

(52) U.S. Cl.
CPC ..... *B65H 35/02* (2013.01); *B65H 2301/4148* (2013.01)

(58) Field of Classification Search
CPC ..... B26D 1/185; B26D 1/245; B26D 7/1863; B26D 7/2635; B65H 2301/4148; B65H 2801/21; B65H 35/02
See application file for complete search history.

(56) References Cited

U.S. PATENT DOCUMENTS 5,031,494 A * 7/1991 Asselborn ..... B26D 7/1863 83/100
5,435,217 A * 7/1995 Kato ..... B26D 1/205 83/100
2010/0258017 A1* 10/2010 Kersey ..... B41J 11/68 101/227

FOREIGN PATENT DOCUMENTS

| | | | |
|---|---|---|---|
| DE | 1873862 | U | 6/1963 |
| DE | 102007000685 | A1 | 3/2009 |
| EP | 2529901 | A1 | 12/2012 |
| GB | 2275013 | B | 6/1995 |
| WO | 2017002138 | A1 | 1/2017 |

OTHER PUBLICATIONS

PCT International Search Report for International application No. PCT/EP2018/025215; dated Mar. 21, 2019; 5 pgs.

* cited by examiner

*Primary Examiner* — Stephen Choi
(74) *Attorney, Agent, or Firm* — Alix, Yale & Ristas, LLP

(57) ABSTRACT

A longitudinal cutting device with a cutting mechanism, which is arranged between an infeed and a delivery and has rotary cutters movable transverse to the transport direction, comprises transport devices that are arranged on the knife receptacles of these rotary cutters and bridge the region of the cutting mechanism with a conveying effect.

11 Claims, 2 Drawing Sheets

LONGITUDINAL CUTTING DEVICE

BACKGROUND

The present invention pertains to a device for longitudinally cutting material webs and/or material sheets according to the preamble of claim 1.

It is known to use rotary board cutters, particularly for longitudinally cutting cardboard sheets, wherein said rotary board cutters comprise cutting shafts that extend over the machine width. The individual circular knives of multiple rotary cutters are fastened on these cutting shafts by means of clamping joints. The cutting shafts are permanently connected to a controllable motor in a driving manner via gear mechanisms. The transport of the stock within the cutting mechanism takes place due to the circumferential speed of the circular knives.

The cutting position can be varied over the width of the stock by loosening the clamping joints, as well as displacing and subsequently fixing the circular knives of a rotary cutter. Each circular knife has to be positioned individually in this case. The adjustment of the upper and lower knives of the same rotary cutter is particularly important for producing a clean cut on the one hand and for preventing excessive wear of the circular knives on the other hand. This manual setup is correspondingly elaborate and susceptible to errors if the dimensional accuracy of the blanks to be produced is subject to stricter requirements.

In addition to the geometry of the individual cutting edges, the overlap of the circular knives of a pair decisively defines the cutting forces. This overlap is adjusted with the distance between the cutting shafts. The overlap of the rotary cutters arranged on the same cutting shaft pair can only be adjusted jointly. This simplifies an overall adjustment of the overlap in order to adjust the device to different properties of the stock. However, an individual correction affecting the individual rotary cutter is not possible.

The rotary cutters may be arranged so closely adjacent to one another that their clamping joints touch one another and strips with a width of a few centimeters can be cut out of the sheet. In order to prevent restricting the potential cutting positions and to keep the setup effort low when the cutting positions are varied, the structural spaces of the infeed and delivery transport systems are strictly separated from the cutting mechanism. Consequently, the transport of the stock within the cutting mechanism is realized by means of the driven rotary cutters only. This means that the smallest possible sheet length is essentially defined by the diameter of the rotary cutters used.

In contrast, the quality of the cut improves as the diameter of the circular knives increases due to the superior guidance properties. Furthermore, larger diameters of the circular knives allow a more rigid design of the cutting mechanism, which in turn has advantageous effects on the quality of the cut. Today's rotary board cutters therefore always represent a compromise between a sound quality of the cut and the smallest possible sheet length.

SUMMARY OF THE INVENTION

The present invention is therefore based on the objective of developing a device that is enhanced in comparison with the prior art and improves the quality of the cut at least for short sheets.

According to the invention, this objective is attained by means of a device with the characteristics of claim 1.

Advantageous enhancements of the invention are defined by the characteristics disclosed in the dependent claims.

BRIEF DESCRIPTION OF THE DRAWINGS

An exemplary embodiment of the invention is described below with reference to the figures, to which we refer with respect to all particulars that are not discussed in greater detail in the description. In these figures.

DETAILED DESCRIPTION

Figure 1:
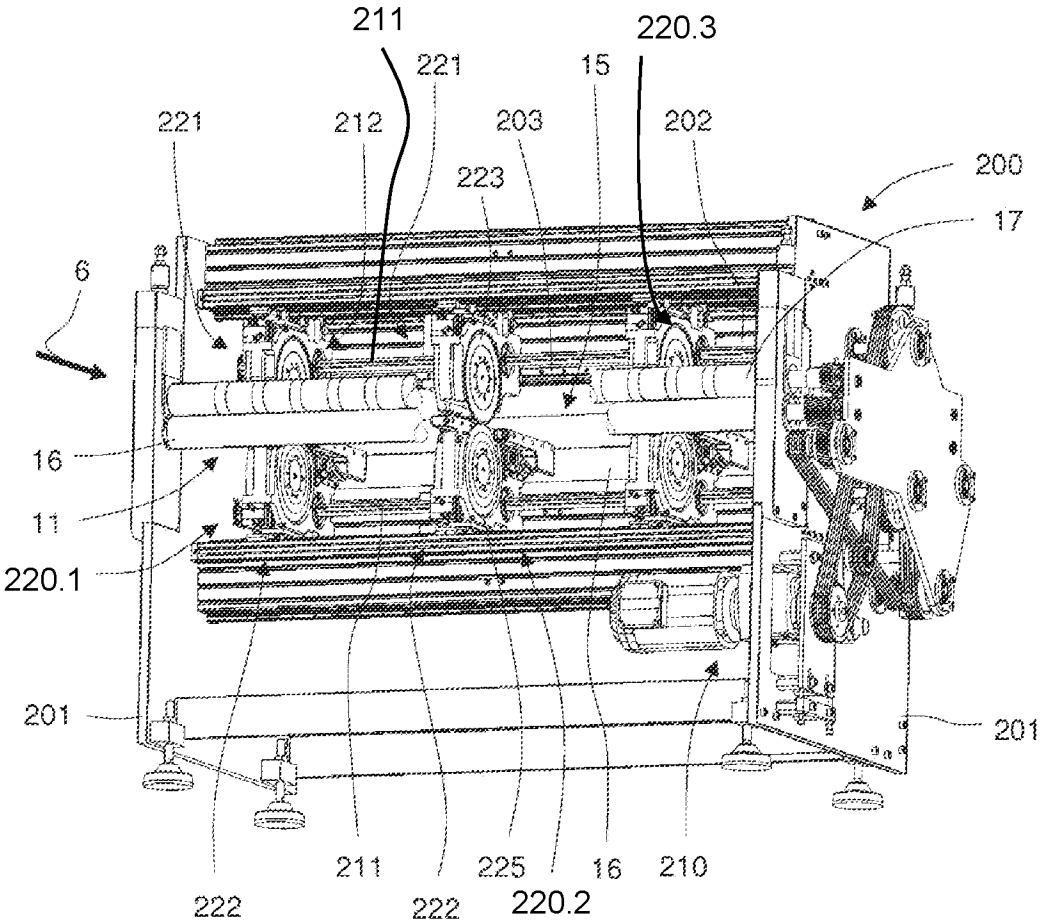
FIG. 1 shows a detail of a longitudinal cutting device.

The apparatuses of the longitudinal cutting device for cardboards illustrated in FIG. 1 are arranged in a common machine frame 200. This machine frame 200 is essentially formed by a pair of sidewalls 201 that are arranged opposite of one another and connected to one another by crossbeams 202. Several of these crossbeams 202 comprise guide rails of linear guides 203 that serve as a support for the rotary cutters 220.1, 220.2, 220.3 of the cutting device.

An infeed 11, the cutting mechanism with the rotary cutters 220.1, 220.2, 220.3 and a delivery 15 are arranged behind one another in this machine frame 200 referred to the process flow direction 6. These apparatuses are jointly driven by a drive 210. This drive 210 is likewise arranged on the machine frame 200 and respectively comprises a shaft 211 extending transverse to the transport direction 6 above and underneath the transport plane 5. Both sides of these two shafts 211 are supported in the sidewalls 201 of the frame 200. They respectively have a multi-spline profile and form sliding seats 212 with the rotary cutters 220.1, 220.2, 220.3.

The infeed 11 and the delivery 15 respectively comprise a pair of cooperating transport rollers 16, 17. Both sides of these transport rollers are respectively supported in the sidewalls 201. The lower transport rollers 16 are arranged directly underneath and parallel to the transport plane 5 illustrated in FIG. 2. The upper transport rollers 17 are aligned parallel to the lower transport rollers 16 and arranged above the transport plane 5. The distance between the rollers of each pair can be adjusted to the thickness of the stock. A not-shown adjusting device of conventional design is provided for this purpose.

The cutting mechanism comprises multiple rotary cutters 220.1, 220.2, 220.3 of the same type. Each of these rotary cutters 220.1, 220.2, 220.3 comprises an upper knife holder 221.1, 221.2 with a respective upper circular knife 223 and a lower knife holder 222.1, 222.2 with a respective lower circular knife 225. The upper circular knives 223 of the rotary cutters 220.1, 220.2, 220.3 are respectively arranged coaxial to one another analogous to the lower circular knives 225.

The knife holders 221, 222 can be displaced transverse to the transport direction 6 of the stock along the linear guides 203 in the form of rotary cutters 220 and fixed by means of clamping devices 205 such that the cutting position is adjustable.

An exemplary lower knife holder 222 is described below.

Figure 2:
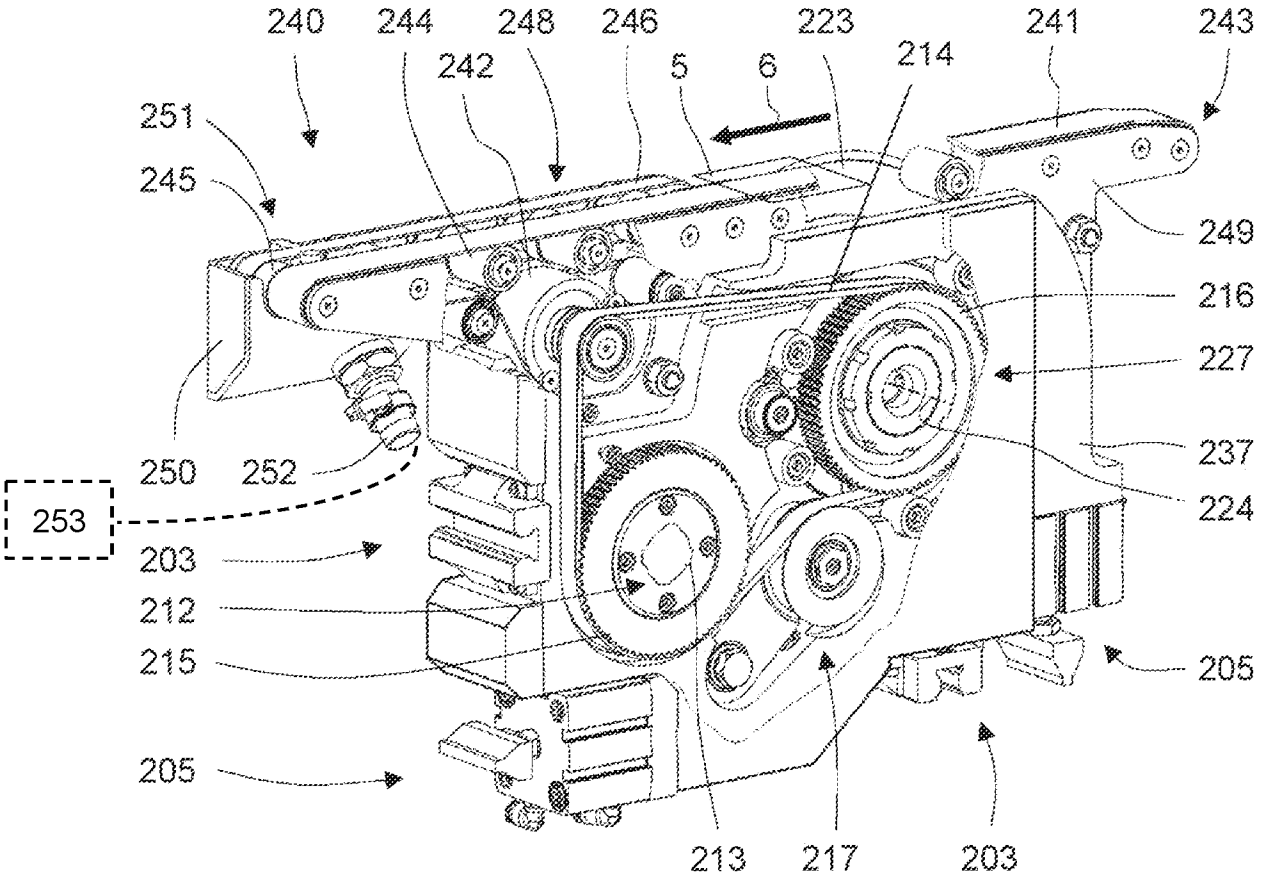
FIG. 2 shows a view of a lower knife holder with integrated transport device.

The lower knife holder 222 illustrated in FIG. 2 has two linear guides 203 that extend parallel to one another. These linear guides 203 are arranged on the carrier 237 at a significant distance from one another and turned relative to one another by 90°. These linear guides 203 serve for receiving the knife holder 222 in the base frame 200 of the device. A respective clamping apparatus 205 is arranged on the carrier 237 adjacent to each of the two linear guides 203. The position of the knife holder 222 along the linear guides 203 and therefore the cutting position are fixed by activating these clamping apparatuses 205.

The circular knife 223 is coaxially fastened on a pulley 216 and supported on a knife receptacle 227 so as to be rotatable about the common axis 224 together with this pulley. This knife receptacle 227 is arranged in the carrier 237 so as to be rotatable eccentric to the circular knife 223 and can be fixed with respect to its rotational position in this carrier.

The circular knife 223 is driven by means of an endless revolving toothed belt 214. This toothed belt is wrapped around the pulley 216 connected to the circular knife 223 on the one hand and around an additional pulley 215 on the other hand, wherein said additional pulley forms a sliding seat 212 with the drive shaft 211 fixed in the frame. For this purpose, the hub of this pulley 215 has a multi-spline profile 213. A belt tensioner 217, which is supported in the carrier 237 and spring-loaded relative to the toothed belt 214, ensures a suitable tension of the toothed belt 214 regardless of the position of the eccentric knife receptacle 227.

The lower knife holder 222 furthermore comprises a transport apparatus 240 that takes hold of the stock with a conveying effect in the region of the cutting mechanism. A first transport belt 241 is provided for this purpose, wherein said first transport belt moves in the transport direction 6 and is wrapped around a first deflection roller 243 and a second deflection roller 245, as well as a transport pulley 242. The deflection rollers 243, 245 and the transport pulley 242 are supported in a receptacle 249. This receptacle 249 is rigidly connected to the carrier 237 of the knife holder 222.

The deflection rollers 243, 245 are respectively arranged upstream and downstream of the circular knife 223 referred to the transport direction 6 in such a way that the first transport belt 241 bridges the cutting mechanism and provides a planar support surface for the stock in this region. Multiple backup rollers 244 are provided between the deflection rollers 243, 245 in order to prevent sagging of the first transport belt 241. These backup rollers 244 are likewise supported in the receptacle 249 of the first transport belt 241.

The first transport belt 241 is driven by means of the aforementioned transport pulley 242. This transport pulley has a coaxial second toothing, around which the toothed belt 214 of the knife holder 222 is wrapped such that the transport pulley is driven together with the circular knife 222. The respective effective diameters of the pulleys 215, 216, 242 and the circular knife 223 are adapted to one another in such a way that the transport speeds of the infeed 11, the delivery 15, the rotary cutter 220 and the associated transport apparatus 240 are identical.

A second transport belt 246 is arranged opposite of the first transport belt 241 referred to the circular knife 223. This second transport belt is wrapped around the correspondingly extended second deflection roller 245 of the first transport belt 241 and driven thereby. The sections of the two transport belts 241, 246 with a conveying effect extend parallel to one another such that the stock is taken hold of with a conveying effect to both sides of the respective rotary cutter 220. The deflection rollers 243, 245, 227 and backup rollers 244, 248 of both transport belts 241, 246 are supported in the common receptacle 249.

The receptacle 249 is realized in the form of a housing 250 in the region located downstream of the circular knife 223 referred to the transport direction 6. The housing 250 is open on its side that faces the transport plane and comprises a connection piece 252. A suction mechanism 253 of conventional design is connected to this connection piece 252. A brush 251 is provided in order to already remove dust accumulating during the cutting process from the stock in the region of the cutting mechanism. This brush is arranged in the housing in the region of its opening with its bristles pointing upward such that it sweeps along the stock.

Instead of a transport belt, the upper knife holders 221 comprise rollers that are freely rotatable about their axes and press the stock against the respective transport belts 241 of the lower knife holder 222.

The invention claimed is:

1. A device for longitudinally cutting webs or sheets of material, such as cardboard or pasteboard, said device comprising a machine frame (200) with at least one pair of oppositely arranged sidewalls (201), an infeed (11) comprising cooperating upper and lower transport rollers arranged above and below a transport plane (5), wherein said infeed is arranged in the machine frame (200) and feeds the webs or sheets to a cutting mechanism of the device in an essentially linear transport direction (6) within the transport plane (5), a driveshaft (211) fixed in the frame, wherein said driveshaft is aligned essentially parallel to the transport plane (5) and transverse to the transport direction (6) and spans a transport region of the webs or sheets, said transport region extending transverse to the transport direction (6), a linear guide (203) that is spaced apart from the at least one drive shaft (211) and essentially arranged parallel to the at least one driveshaft (211) and spans the transport region, and the cutting mechanism is arranged in the machine frame (200) and comprises at least one rotary cutter (220) including at least two circular knives (223, 225), wherein each of the at least two circular knives (223, 225) of the rotary cutter (220) is respectively arranged in a knife holder (221, 222) and at least one of the knife holders (221, 222) is arranged so as to be movable along the at least one linear guide (203) transverse to the transport direction, wherein said device includes at least one transport (240) that is arranged in the cutting mechanism and comprises at least one transport element (241, 246), which is arranged on a carrier (237) with at least one circular knife (223) so as to be movable transverse to the transport direction (6) to any position along the at least one linear guide (203), wherein said at least one transport element takes hold of the webs or sheets with a conveying effect at least in a region between the rotational axes of the circular knives (223, 225) of the at least one rotary cutter (220) and transports the webs or sheets through the cutting mechanism in the transport direction (6).

2. The device of claim 1, wherein the region where the at least one transport element (241, 246) takes hold of the webs or sheets extends at least over an area of the transport plane (5) penetrated by the knives (223, 225).

3. The device of claim 1, wherein the at least one transport element (241, 246) of the transport device (240) is formed by an endless revolving transport element (241, 246), which forms a support for the webs or sheets at least in the region of the circular knife (223).

4. The device of claim 1, wherein the at least one transport element (241, 246) is associated with one of the at least two circular knives (223, 225) and movable along the at least one linear guide (203) together with this circular knife.

5. The device of claim 4, wherein the at least one transport element (241, 246) is arranged on the knife holder (222) of the respectively associated circular knife (223).

6. The device of claim 4 wherein the carrier (237) of the at least one transport element (241, 246) is connected to a carrier (237) of the knife holder (222) of the rotary cutter.

7. The device of claim 1, comprising a drive connection of the at least one transport element (241, 246) to the drive shaft (211).

8. The device of claim 7, wherein said drive connection comprises a common drive connection of the at least one transport element (241, 246) and the respectively associated circular knife (223) to the at least one drive shaft (211).

9. The device of claim 1, wherein the carrier (249) of the at least one transport element (241, 246) comprises a housing (250), which has at least one opening toward the transport plane (5), and a suction line (252) leading into the housing (250), wherein a suction mechanism (253) applies suction to the suction line (252) to gather and remove dust accumulating during the cutting process.

10. The device of claim 1, wherein the at least one transport element comprises transport elements (241, 246) transversely spaced from each other with the same associated circular knife (223) positioned between the transport elements (241, 246).

11. The device of claim 1, wherein the at least one transport element (241, 246) of the transport (240) comprises a transport belt (241) wrapped around a first deflection roller (243) and a second deflection roller (245) wherein the first and second deflection rollers (243, 245) are respectively arranged upstream and downstream of the circular knives (223, 225) in the transport direction (6).

* * * * *